US010595140B2

(12) United States Patent
Beyfuss et al.

(10) Patent No.: US 10,595,140 B2
(45) Date of Patent: Mar. 17, 2020

(54) ELECTRONIC FRAME FOR MAINTAINING ELECTRONIC COMPONENTS OF A HEARING AID, HEARING AID AND KIT FOR A HEARING AID

(71) Applicant: SIVANTOS PTE. LTD., Singapore (SG)

(72) Inventors: Stefanie Beyfuss, Erlangen (DE); Bjoern Freels, Erlangen (DE); Anand Ganapathy, Singapore (SG); Holger Kral, Fuerth (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/214,854

(22) Filed: Dec. 10, 2018

(65) Prior Publication Data

US 2019/0110142 A1 Apr. 11, 2019

Related U.S. Application Data

(63) Continuation of application No. PCT/EP2017/064191, filed on Jun. 9, 2017.

(30) Foreign Application Priority Data

Jun. 10, 2016 (DE) ..... 10 2016 210 342

(51) Int. Cl.
*H04R 25/00* (2006.01)

(52) U.S. Cl.
CPC ..... *H04R 25/602* (2013.01); *H04R 25/65* (2013.01); *H04R 2225/31* (2013.01); *H04R 2420/09* (2013.01)

(58) Field of Classification Search
CPC .. H04R 25/602; H04R 25/65; H04R 2420/09; H04R 2225/31; H01R 13/2442; H01R 13/2457; H01R 11/286
(Continued)

(56) References Cited

U.S. PATENT DOCUMENTS 5,188,540 A 2/1993 Haertl et al.
5,799,095 A * 8/1998 Hanright ..... H04R 25/556 381/312
(Continued)

FOREIGN PATENT DOCUMENTS

DE 3723809 A1 1/1989
DE 4109306 C1 7/1992
(Continued)

*Primary Examiner* — Tuan D Nguyen
(74) *Attorney, Agent, or Firm* — Laurence A. Greenberg; Werner H. Stemer; Ralph E. Locher

(57) ABSTRACT

An electronics frame for a hearing device serves to hold electronic components and has a contact carrier. The carrier in turn has a first line connector, a second line connector, and a third line connector. The three line connectors serve to electrically contact at least one of the electronic components with a first connection contact, a second connection contact which is at a potential that is different from the first connection contact, and with a third connection contact of a storage battery module which has a rechargeable battery. The contact carrier moreover has a first insertion slot for receiving a first contact arm which serves to electrically contact a contact of a two-pole battery. A kit for the hearing device contains, in addition to the hearing device with the electronics frame, the storage battery module and at least the first contact arm for subsequent mounting on the contact carrier.

16 Claims, 3 Drawing Sheets

(58) Field of Classification Search
USPC ..... 381/322, 324, 380, 381
See application file for complete search history.

(56) References Cited

U.S. PATENT DOCUMENTS

| | | | | |
|---|---|---|---|---|
| 7,226,297 | B2 * | 6/2007 | Li | H01R 13/2442 439/607.01 |
| 2002/0191806 | A1 | 12/2002 | Rohrseitz et al. | |
| 2005/0142928 | A1 * | 6/2005 | Ono | H01R 12/57 439/500 |
| 2006/0159298 | A1 * | 7/2006 | von Dombrowski | H04R 25/48 381/330 |
| 2011/0058697 | A1 * | 3/2011 | Shennib | H04R 25/02 381/314 |
| 2013/0294627 | A1 * | 11/2013 | Karlsen | H04R 25/60 381/322 |
| 2016/0029133 | A1 | 1/2016 | Cano et al. | |
| 2016/0365751 | A1 | 12/2016 | Hatanaka et al. | |

FOREIGN PATENT DOCUMENTS

| | | | |
|---|---|---|---|
| EP | 1246504 | A2 | 10/2002 |
| WO | 2015125965 | A1 | 8/2015 |

* cited by examiner

ELECTRONIC FRAME FOR MAINTAINING ELECTRONIC COMPONENTS OF A HEARING AID, HEARING AID AND KIT FOR A HEARING AID

CROSS-REFERENCE TO RELATED APPLICATION

This is a continuation application, under 35 U.S.C. § 120, of copending international application No. PCT/EP2017/064191, filed Jun. 9, 2017, which designated the United States; this application also claims the priority, under 35 U.S.C. § 119, of German patent application No. DE 10 2016 210 342.3, filed Jun. 10, 2016; the prior applications are herewith incorporated by reference in their entirety.

BACKGROUND OF THE INVENTION

Field of the Invention

The invention relates to an electronics frame for holding electronic components of a hearing device. Such electronic components are formed, for example, by microphones, loudspeakers, signal processors and the like. The invention moreover relates to a hearing device with such an electronics frame, and to a kit for such an electronics frame.

The term "hearing device" here and below encompasses in particular devices which serve to assist people with impaired hearing capacity (hearing devices for this purpose are usually referred to as "hearing aids"), for tinnitus therapy (so-called tinnitus maskers), or for communication purposes (for example, as headsets). In particular hearing aids usually have at least one microphone for detecting noises in the vicinity of a person wearing the hearing device. Hearing aids moreover often have a signal processing unit, which is also referred to as a signal processor, by which the detected noises are filtered, partially amplified, and/or damped, and may be adapted in a different form to the reduced hearing of the person wearing the hearing device. The noises processed in this way are output to the ear of the person wearing the hearing device by means of a loudspeaker, also referred to as an earpiece. As an alternative to the loudspeaker, devices for mechanically or electrically stimulating the hearing of the person wearing the hearing device can also be used (for example, a cochlea implant).

In order to supply energy to the above described (electronic) components of a hearing device, non-chargeable batteries, in particular button cells (also referred to as button batteries), preferably of a zinc-air design, are used. Alternatively, rechargeable energy sources (also referred to as storage batteries) are also used, in particular in highly priced hearing devices.

SUMMARY OF THE INVENTION

The object of the invention is to simplify the production of hearing devices with a different energy supply.

The electronics frame according to the invention serves to hold electronic components of a hearing device. The electronics frame thus preferably serves for use in a hearing device. The electronics frame contains a contact carrier which in turn has a first, second, and third line connector for electrically contacting at least one of the electronic components (which are in particular held on the electronics frame) with an (associated) first connection contact, a second connection contact which has an (electrical) potential that is different from the first connection contact, and with a third connection contact of a storage battery module. The storage battery module here contains a rechargeable battery. The three line connectors of the contact carrier are moreover connected in each case to the end of an associated contact spring which serves to contact the connection contacts of the storage battery module. These three contact springs are here preferably arranged next to one another on a surface of the contact carrier, which is preferably cuboid in shape, and thus are situated with their associated contact ends in a common (contact) plane. The contact carrier furthermore has a first contact arm which serves to electrically contact a contact (also referred to as a pole or contact face) of a two-pole battery. This first contact arm is here integrally formed with the first contact spring associated with the first line connector of the contact carrier.

The two-pole battery is preferably a button cell (also a button battery) which in particular takes the form of a non-chargeable battery (also referred to as a primary cell) in the form of a zinc-air battery. Alternatively, however, it can here also be a rechargeable battery (also referred to as a secondary cell or storage battery) of the same design. The first contact arm preferably serves to contact the button cell at its end side. The button cell is optionally contacted, in the proper contacting state, on its circumferential surface by the contact spring associated with the second line connector.

One of the two electrical potentials associated with the first or second connection contact of the storage battery is preferably a reference potential, in particular a ground potential. The other potential is different.

The third connection contact of the storage battery preferably takes the form of a control contact by which the transducer electronic unit of the storage battery module is activated and deactivated when the hearing device is switched on and off.

The electronics frame is preferably formed by a conductor plate (which in particular has a three-dimensional shape) or contains such a conductor plate (or a planar one). n the latter case, the contact carrier is preferably fastened on the conductor plate and hence indirectly on the electronics frame.

By virtue of the first contact arm, it is advantageously possible that the electronics frame, which is fundamentally configured and provided for operation with the storage battery module, can also be easily used for operation with a conventional battery, in particular a button cell. Storage costs entailed by a large number of different hearing device components adapted for different energy sources which need to be employed thus no longer exist.

In a preferred embodiment, the first contact arm projects with its associated contact end above the plane of the contact ends of the contact springs of the contact carrier. A contact face formed on the contact end of the first contact arm is in particular here oriented so that it is transverse to those contact faces of the contact springs which lie in the common plane. It is consequently in particular made possible for the first contact arm to contact the button cell on one of its end faces when the button cell has been inserted properly. A second contact face of the button cell which is at a different potential to this end face is here arranged at its circumferential surface and is preferably contacted by that contact spring of the contact carrier which is associated with the electrical potential of the circumferential surface. For this case, when the button cell has been inserted properly, the button cell is moreover expediently held in a battery compartment door which is arranged so that it can pivot with respect to the electronics frame. The battery compartment door thus preferably protects both of the other contact springs of the contact carrier from contamination with the button cell and hence from a short-circuit.

In an expedient embodiment, the contact carrier has a second contact arm which is preferably integrally formed with the second line connector, which is associated with an electrical potential which is different in particular from the first line connector. Both contact arms are hereby in particular configured so as to contact the button cell on its respective flat sides (i.e. the opposite end sides). In this case, the second contact arm thus expediently also projects with its contact end above the plane of the contact springs, similarly to the first contact arm, in the manner described above.

The third contact spring of the contact arm associated with the control contact of the storage battery module is preferably formed so that it is in particular independent of the first and possibly the second contact arm, i.e. is insulated from the respective contact arm.

In a preferred embodiment, the first contact arm and the second contact arm, which may be present, each protrude from a side face, which differs from the surface which comprises or carries the contact springs, of the in particular cuboid contact carrier.

The hearing device according to the invention contains the above-described electronics frame (and hence also the contact carrier with the integrated first contact arm). The hearing device preferably also has a housing in which the electronics frame is arranged.

In an expedient embodiment, the hearing device also comprises the abovementioned battery compartment door, articulated pivotably with respect to the electronics frame on the latter or on the housing, in particular for reversibly holding the button cell. By means of the battery compartment door, the button cell can be moved in particular for switching the hearing device on and off between an operating position, where contact is made with the first (and possibly the second) contact arm, and an inactive position, in which the battery is distanced from the first contact arm (and possibly the second contact arm). The hearing device contains the above-described storage battery module as an alternative to the battery compartment door.

Where the first and the second contact arm are present on the contact carrier, the battery compartment door is preferably configured such that it insulates the circumferential side of the button cell from the three contact springs of the contact carrier (in the proper contacting state with the first and the second contact arm).

The kit according to the invention serves in particular for optionally equipping the above-described electronics frame for use with the storage battery module or with the button cell. For this purpose, the kit contains, in addition to the above-described hearing device which has in particular the electronics frame of the above-described type, the storage battery module and the above-described battery compartment door, which are configured for optional mounting on the electronics frame or the housing of the hearing device.

The electronics frame according to the invention serves to hold electronic components of a hearing device. The electronics frame thus serves for use in a hearing device. The electronics frame contains a contact carrier which in turn has a first, second, and third line connector for electrically contacting at least one of the electronic components, held on the electronics frame, with an (associated) first connection contact, a second connection contact which is at a different (electrical) potential from the first connection contact, and with a third connection contact of a storage battery module. This storage battery module here contains a rechargeable battery. The contact carrier furthermore has at least one insertion slot for receiving in each case one contact arm. When mounted properly, this contact arm serves to electrically contact a contact (also referred to as a pole or contact face) of a two-pole battery.

The components of this embodiment described here in principle also correspond to the components of the above-described electronics frame (or the corresponding hearing device). The two-pole battery is likewise preferably the above-described button cell. The same applies to the electrical potentials and the connection contacts of the storage battery module, and to the electronics frame or its conductor plate.

By virtue of the insertion slot, it is advantageously possible that the electronics frame, which is in principle configured and provided for operation with the storage battery module, can be easily adapted or possibly retrofitted for operation with a button cell, in particular during the production of the hearing device. Storage costs entailed by a large number of different hearing device components adapted for different energy sources which need to be employed thus no longer exist. This is because, according to the invention, a high number of identical parts can be used for the corresponding hearing devices, both for non-chargeable and rechargeable batteries, in particular by only the above-described contact arm being used in the contact carrier, when there is a requirement for operation with a button cell.

In a preferred embodiment, the first line connector is open in the insertion slot. This means that, when the first contact arm is inserted into the insertion slot, the first contact arm is electrically contacted directly or indirectly (for example, by means of an electrically conductive adhesive) with the first line connector of the contact carrier.

In a further expedient embodiment, the three line connectors of the contact carrier are connected in each case at their ends to an associated contact spring. These three contact springs are here arranged in particular next to one another on a surface of the contact carrier, which preferably is cuboid in shape—and are thus situated with their associated contact springs in a common (contact) plane.

In a preferred embodiment, in particular for the above-described case where the three contact springs are arranged next to one another in a common plane, in the proper mounting state the first contact arm projects with its associated contact end above the plane of the contact ends of the contact springs of the contact carrier. A contact face formed on the contact end of the first contact arm is thus in particular oriented transversely with respect to those contact faces of the contact springs which are situated in a common plane. It is consequently made possible for the first contact arm to contact the button cell on one of its end faces when it has been inserted properly. A second contact face, which is at a different potential from this end face, of the button cell is here arranged on its circumferential surface (also referred to as circumferential surface) and is preferably contacted by that contact spring of the contact carrier which is associated with the electrical potential of the circumferential surface. For this case, when inserted properly, the button cell is moreover expediently held in a battery compartment door arranged so that it can pivot with respect to the electronics frame. This battery compartment door here preferably protects the two other contact springs of the contact carrier from contact with the button cell and hence from a short-circuit.

In a further expedient embodiment, which is also viewed as an independent invention, the contact carrier has a second insertion slot for receiving a second contact arm. In the proper mounting state, the above-described first contact arm is thus connected to the first line connector, and the second contact arm to the second line connector, which is associated with a different potential than the first line connector. The first and the second contact arm are in particular configured and provided so as to contact the button cell, when inserted properly, on its opposite end sides. Both contact arms thus also each have a contact portion (at least the respective contact end) which projects above the (above-described) plane of the contact springs and serves to contact the corresponding flat side (end side) of the button cell.

In a preferred development of the above embodiment, when properly inserted the button cell is preferably (also) held in a battery compartment door. The battery compartment door is here configured such that it insulates the circumferential side of the button cell (when properly contacting the first and the second contact arm) from the three contact springs of the contact carrier.

In an expedient development, the first and possibly also the second contact arm are designed as part of the contact carrier, i.e. the first and possibly also the second contact arm, both in the embodiment of the electronics frame provided for use with the button cell and in the embodiment of the electronics frame provided for use with the storage battery module, is arranged, in particular is fixed, in the first or second insertion slot of the contact carrier, and electrically contacts the first or the second line connector.

In each case, the third contact spring, associated with the control contact of the storage battery module, of the contact carrier is configured in particular so that it is independent of the first and possibly the second contact arm, i.e. is insulated from the latter.

The hearing device according to the invention contains the above-described electronics frame and the first contact arm mounted on the contact carrier.

The hearing device advantageously also contains a housing in which the electronics frame is arranged, and a battery compartment door, articulated pivotably with respect to the electronics frame on the latter or on the housing, for reversibly holding the button cell. By means of the battery compartment door, the button cell can be moved in particular for switching the hearing device on and off between an operating position, where contact is made with the first (and possibly the second) contact arm, and an inactive position, in which the battery is distanced from the first contact arm (and possibly the second contact arm).

The kit according to the invention serves in particular for optionally equipping the above-described electronics frame for use with the storage battery module or with the button cell. For this purpose, the kit contains, in addition to the above-described hearing device which has in particular the electronics frame of the above-described type, at least the first (above-described) contact arm which is configured and provided for subsequent mounting on the contact carrier, specifically in its insertion slot. The kit furthermore also contains the storage battery module, and the above-described battery compartment door, which are configured for optional mounting on the electronics frame or the housing of the hearing device.

Other features which are considered as characteristic for the invention are set forth in the appended claims.

Although the invention is illustrated and described herein as embodied in an electronic frame for maintaining electronic components of a hearing aid, a hearing aid and a kit for a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
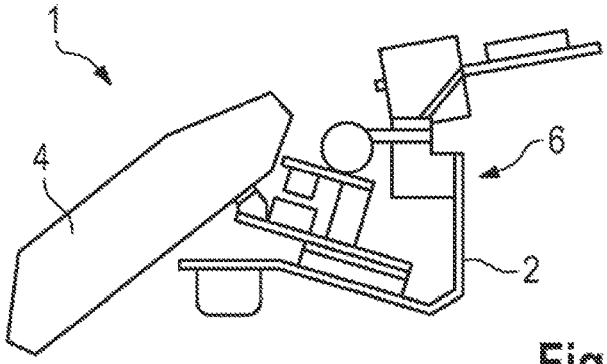
FIG. 1 is a diagrammatic, side view of an electronics frame of a hearing device according to the invention.

Mutually corresponding parts are provided with the same reference numerals in all the figures.

Referring now to the figures of the drawings in detail and first, particularly to FIG. 1 thereof, there is shown an electronics frame 1 of a hearing device. The electronics frame 1 contains a basic body 2 on which in the state shown electronic components, such as for example a microphone module 4 (which has two microphones) and a plurality of electronic parts which serve for signal-processing the noises captured by the microphone module 4. The basic body 2 is formed in the above example by a conductor plate with a three-dimensional shape. A connection face 6, on which, in the proper mounting state, contact elements serve to contact the electronic components with an energy source, is moreover formed on the base body 2.

Figure 2:
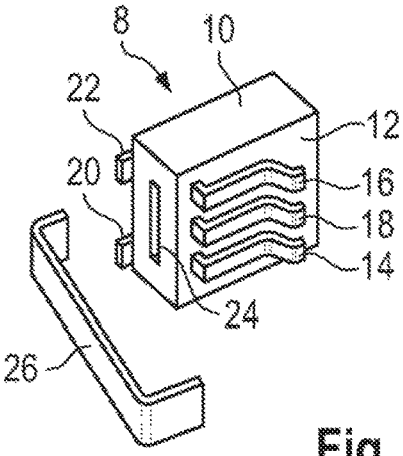
FIG. 2 is a perspective view of a contact carrier for mounting on the electronics frame, and a contact arm for mounting on the contact carrier.

A contact carrier 8, which is configured and provided for mounting on the connection face 6, is shown in FIG. 2. The contact carrier 8 has a cuboid basic body 10, on a front side 12 of which a first contact spring 14, a second contact spring 16, and a third contact spring 18 are arranged. The contact springs 14, 16, and 18 are here connected to three line connectors which are integrated in the basic body 10 of the contact carrier 8, and a first line connector 20 and a second line connector 22 of which can be seen in FIG. 2. The third line connector 23 can be seen in FIGS. 7 and 8. The contact carrier 8 furthermore has an insertion slot 24 which is arranged in the basic body 10 and is configured for receiving a first contact arm 26. The first line connector 20 lies open in the insertion slot 24 such that the former is electrically connected to the first contact arm 26 when the latter is inserted.

Figure 3:
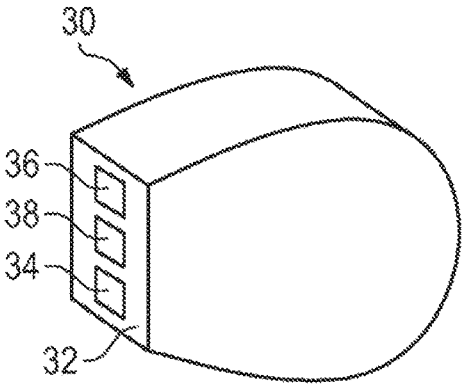
FIG. 3 is a perspective view of a storage battery module for contacting the contact carrier.

The contact carrier 8 is in principle configured and provided for contacting a storage battery module 30 shown in FIG. 3. The storage battery module 30 has a rechargeable battery (referred to below as a storage battery) and a transducer electronic unit which serves to adapt the output voltage value supplied by the storage battery to an operating voltage value required for operating the electronic components of the hearing device. The storage battery module 30 moreover also has a charging electronic unit having an antenna for receiving energy wirelessly. The storage battery module 30 furthermore has three connection contacts next to one another on a circumferential surface 32 and hence corresponding to the contact ends (which serve for contacting) of the contact springs 14, 16, and 18. The first and second connection contacts 34 and 36 corresponding to the contact springs 14 and 16 are thus at a different electrical potential. The first connection contact 34 is thus correctly at a ground potential.

The third connection contact of the storage battery module 30 represents a control contact 38 by which the transducer electronic unit of the storage battery module 30 is activated or deactivated when the hearing device is switched on and off. The connection contacts 34 and 36, and the control contact 38, are in electrical contact with the contact springs 14, 16, and 18 in the proper mounting state of the hearing device.

Figure 4:
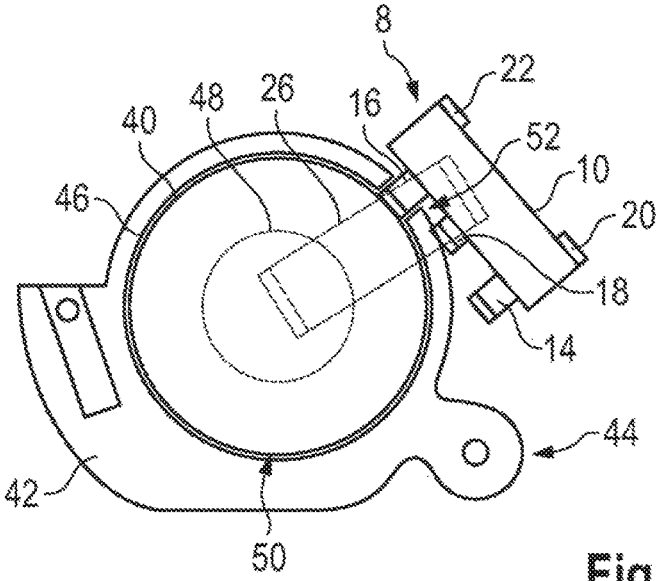
FIG. 4 is a top, plan view of a battery compartment door with an inserted battery.

In order also to be able to operate the hearing device with an alternative to the storage battery module 30, by a conventional hearing device battery which takes the form of a non-chargeable (zinc-air) button cell 40, in an alternative variant shown in FIG. 4 the hearing device contains a battery compartment door 42. In the proper mounting state, the battery compartment door 42 is articulated by a hinge 44 so that it can pivot on the electronics frame 1 or on a housing of the hearing device (not shown in detail). For use of the button cell 40, the first contact arm 26 is moreover first inserted into the insertion slot 24 and hence contacts the first line connector 20. A pot-like depression 46, in which the button cell 40 is laid when properly inserted (see FIG. 4), is formed in the battery compartment door 42. An opening 48, through which the first contact arm 26 (in the proper contacting state shown in FIG. 4) is in contact with one of the end faces of the button cell 40, is here arranged in the "base of the pot" of the depression 46. A circumferential surface 50, at a different electrical potential from this end face, of the button cell 40 is, in the proper contacting state, in electrical contact with the second contact spring 16 via a gap 52 in the side wall of the battery compartment door 42. The third contact spring 18 thus bears against the side wall of the battery compartment door 42 and is hence insulated from the battery 40.

Figure 5:
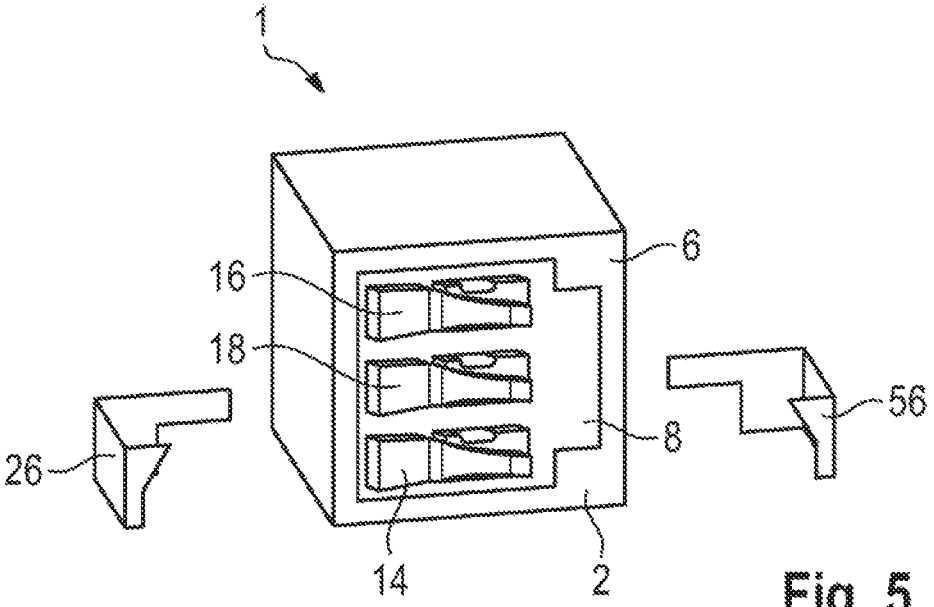
FIG. 5 is a perspective view of an alternative exemplary embodiment of the contact carrier held on the electronics frame.
Figure 6:
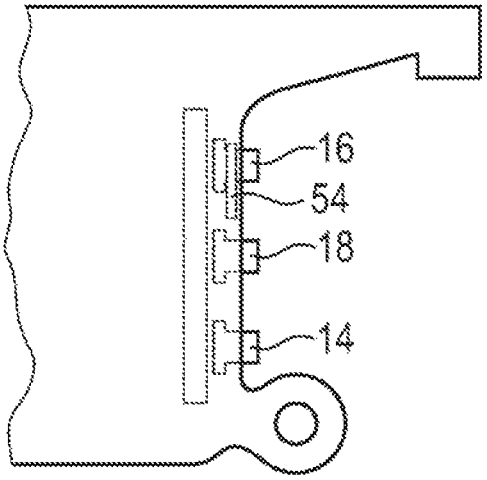
FIG. 6 is a side view of the contact carrier according to FIG. 5.

An alternative exemplary embodiment of the contact carrier 8 is shown in FIG. 5 in the proper mounting state on the electronics frame 1. In addition to the insertion slot 24, the contact carrier 8 here has a second insertion slot 54 (see FIG. 6) in which a second contact arm 56 can be accommodated. In this case, the second contact arm 56 serves to grip the button cell 40 on its respective end faces (at different potentials) in order to make contact. In this case, the battery compartment door 42 does not have the perforation 52, such that the three contact springs 14, 16, and 18 are protected from contacting the circumferential surface 50 of the button cell 40, and hence from a short-circuit.

Figure 7:
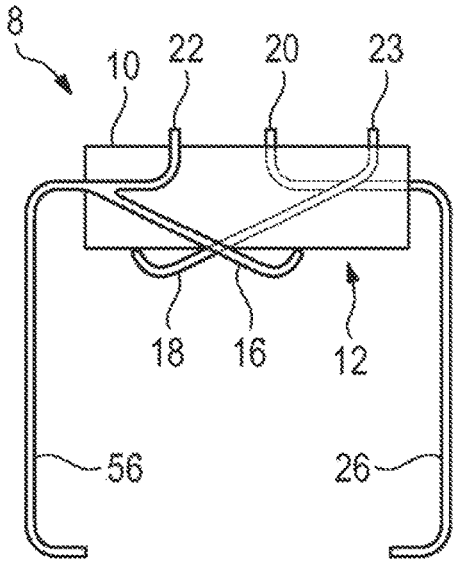
FIG. 7 is a sectional view of a third exemplary embodiment of the contact carrier.
Figure 8:
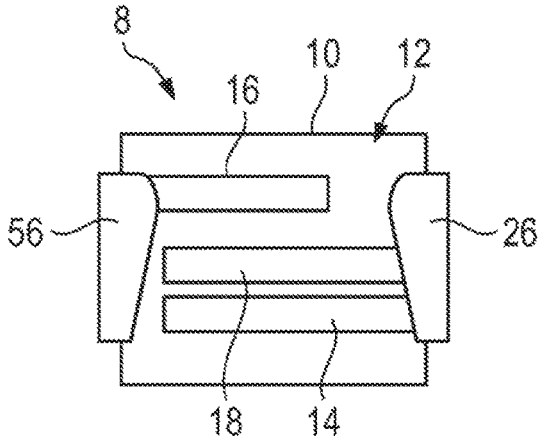
FIG. 8 is a front view of the third exemplary embodiment of the contact carrier.

A further exemplary embodiment of the contact carrier 8 is shown in FIGS. 7 and 8. In this case, the contact springs 14 and 16 are integrally formed with the contact arms 26 and 56 and with the line connectors 20 and 22. In other words, the contact carrier 8 is constantly configured for contacting both the storage battery module 30 and the button cell 40. As has already been described with the aid of the exemplary embodiment according to FIGS. 5 and 6, here too, when the button cell 40 is used, the contact springs 14, 16, and 18 are protected by the (side wall of the) battery compartment door 42 from contacting the circumferential surface 50 of the button cell 40. As can be seen in FIGS. 7 and 8 (and also 9 and 10), the contact carrier 8 hereby does not have either of the insertion slots 24 and 52.

Figure 9:
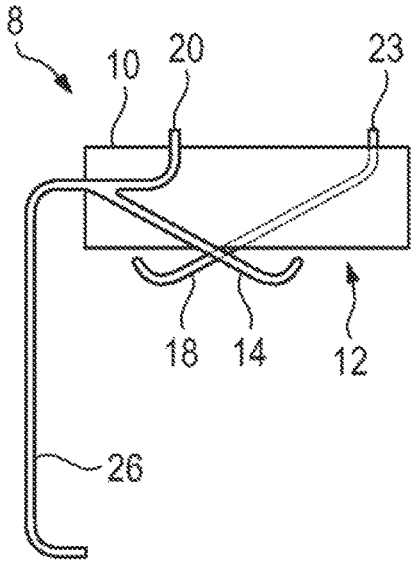
FIG. 9 is a sectional view of a fourth exemplary embodiment of the contact carrier.
Figure 10:
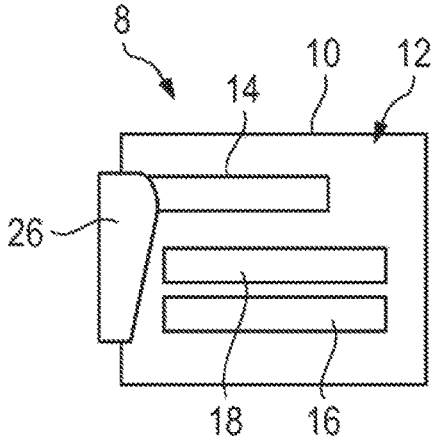
FIG. 10 is a front view of the fourth exemplary embodiment of the contact carrier.

An alternative exemplary embodiment of the contact carrier 8 is in turn shown in FIGS. 9 and 10. In this case, (only) the first contact arm 26 is integrally formed with the line connector 20 and with the contact spring 14. The second contact arm 56 is not present in this exemplary embodiment. This exemplary embodiment is thus identical to the exemplary embodiment according to FIG. 2 with the one difference that the contact arm 26 is at all times present, i.e. in the embodiment of the hearing device for use with the storage battery module 30 and in the embodiment for use with the button cell 40.

In the exemplary embodiments in FIGS. 7 and 8, and 9 and 10, the above-described battery compartment doors 42 also serve to hold the button cell 40.

The subject of the present invention is not limited to the above-described exemplary embodiments. Instead, further embodiments of the invention can be deduced by a person skilled in the art from the above description. In particular, the individual features of the invention described with the aid of the various exemplary embodiments, and their variants, can also be combined with each other in different fashions.

The following is a summary list of reference numerals and the corresponding structure used in the above description of the invention:

1 electronics frame
2 basic body
4 microphone module
6 connection surface
8 contact carrier
10 basic body
12 front side
14 first contact spring
16 second contact spring
18 third contact spring
20 first line connector
22 second line connector
23 third line connector
24 insertion slot
26 first contact arm
30 storage battery module
32 circumferential surface
34 first connection contact
36 second connection contact
38 control contact
40 button cell
42 battery compartment door
44 hinge
46 depression
48 opening
50 circumferential surface
52 perforation
54 second insertion slot
56 second contact arm

The invention claimed is:

1. An electronics frame for holding electronic components of a hearing device, the electronics frame comprising:

a contact carrier containing three line connectors including a first line connector, a second line connector, and a third line connector, said three line connectors being configured for electrically contacting at least one of the electronic components with a first connection contact, a second connection contact which is at a potential that is different from the first connection contact, and with a third connection contact of a storage battery module having a rechargeable battery, said contact carrier having contact springs, said three line connectors connected in each case to an end of one of said contact springs for contacting the connection contacts of the storage battery module, said contact springs formed on a surface of said contact carrier and disposed with contact ends in a common plane; and a first contact arm for electrically contacting a contact of a two-pole battery, said first contact arm being part of said contact carrier and integrally formed with a first of said contact springs associated with said first line connector of said contact carrier.

2. The electronics frame according to claim 1, further comprising a second contact arm which is formed as part of said contact carrier and integrally with a second one of said contact springs associated with said second line connector.

3. The electronics frame according to claim 2, wherein at least one of said first contact arm or said second contact arm projects with an associated contact end above the common plane of said contact ends of said contact springs.

4. The electronics frame according to claim 2, wherein at least one of said first contact arm or said second contact arm protrude from a side face of said contact carrier, which differs from said surface which contains said contact springs of said contact carrier.

5. A hearing device, comprising:

the electronics frame for holding the electronic components according to claim 1.

6. The hearing device according to claim 5, further comprising:

a battery compartment door, articulated pivotably on said electronics frame or on a housing of the hearing device, for holding the two-pole battery; or the storage battery module.

7. The hearing device according to claim 6, wherein said battery compartment door has an opening formed therein and, through which, in a contacting state, said first contact arm is in contact with a corresponding contact of the two-pole battery.

8. A kit for a hearing device having an electronics frame for holding electronic components of the hearing device, the electronics frame containing:

a contact carrier containing three line connectors including a first line connector, a second line connector, and a third line connector, the three line connectors being configured for electrically contacting at least one of the electronic components with a first connection contact, a second connection contact which is at a potential that is different from the first connection contact, and with a third connection contact of a storage battery module having a rechargeable battery, the contact carrier having contact springs, the three line connectors connected in each case to an end of one of the contact springs for contacting the connection contacts of the storage battery module, the contact springs formed on a surface of the contact carrier and disposed with contact ends in a common plane; and a first contact arm for electrically contacting a contact of a two-pole battery, the first contact arm being part of the contact carrier and integrally formed with a first of the contact springs associated with the first line connector of the contact carrier;

the kit comprising:

the storage battery module; and a battery compartment door articulated pivotably on the electronics frame or on a housing of the hearing device for holding the two-pole battery.

9. An electronics frame for holding electronic components of a hearing device, the electronics frame comprising:

a contact carrier having three line connectors including a first line connector, a second line connector, and a third line connector, said three line connectors being configured for electrically contacting at least one of the electronic components with a first connection contact, a second connection contact which is at a potential that is different from the first connection contact, and with a third connection contact of a storage battery module having a rechargeable battery, said contact carrier having a first insertion slot formed therein for receiving a first contact arm which serves for electrically contacting a contact of a two-pole battery.

10. The electronics frame according to claim 9, wherein said first line connector for contacting the first contact arm extends into said first insertion slot.

11. The electronics frame according to claim 9, wherein:

said three line connectors are connected in each case to an end of one of said contact springs for contacting the connection contacts of the storage battery module;

said contact springs have contact ends; and said contact springs are formed on a surface of said contact carrier and are disposed with said contact ends in a common plane.

12. The electronics frame according to claim 11, wherein in a mounting state, the first contact arm projects with an associated contact end above the common plane of said contact ends of said contact springs.

13. The electronics frame according to claim 9, wherein said contact carrier has a second insertion slot formed therein for receiving a second contact arm, and wherein, in a mounting state, the first contact arm is connected to said first line connector, and the second contact arm to said second line connector which is associated with a different potential from said first line connector.

14. A hearing device, comprising:

the electronics frame according claim 9; and said first contact arm.

15. A kit for a hearing device having an electronics frame for holding electronic components of the hearing device, the electronics frame containing:

a contact carrier containing three line connectors including a first line connector, a second line connector, and a third line connector, the three line connectors being configured for electrically contacting at least one of the electronic components with a first connection contact, a second connection contact which is at a potential that is different from the first connection contact, and with a third connection contact of a storage battery module having a rechargeable battery, the contact carrier having contact springs, the three line connectors connected in each case to an end of one of the contact springs for contacting the connection contacts of the storage battery module, the contact springs formed on a surface of the contact carrier and disposed with contact ends in a common plane; and a first contact arm for electrically contacting a contact of a two-pole battery, the first contact arm being part of the contact carrier and integrally formed with a first of the contact springs associated with the first line connector of the contact carrier;

the kit comprising:

said storage battery module for mounting on the electronics frame or a housing of the hearing device;

said first contact arm for mounting on the contact carrier; and a battery compartment door, being articulated pivotably on the electronics frame or a housing of the hearing device, for holding the two-pole battery.

16. The kit according to claim 15, wherein said battery compartment door has an opening formed therein, through which, in a contacting state, said first contact arm is in contact with a corresponding contact of the two-pole battery.

* * * * *